US006862972B2

(12) United States Patent
Morrison

(10) Patent No.: US 6,862,972 B2
(45) Date of Patent: Mar. 8, 2005

(54) ADDITIVE INJECTION DEVICE

(76) Inventor: James Morrison, R.R. 1, Site 14, Comp 1, Fort St. John, BC V1J 4M6 (CA)

( * ) Notice: Subject to any disclaimer, the term of this patent is extended or adjusted under 35 U.S.C. 154(b) by 128 days.

(21) Appl. No.: 10/326,406

(22) Filed: Dec. 23, 2002

(65) Prior Publication Data

US 2004/0118274 A1 Jun. 24, 2004

(51) Int. Cl.[7] ..... F01L 25/02
(52) U.S. Cl. ..... 91/303; 91/350; 60/417
(58) Field of Search ..... 91/303, 329, 350, 91/348; 60/414, 415, 417

(56) References Cited

U.S. PATENT DOCUMENTS 3,649,136 A * 3/1972 Ruidisch ..... 91/303
4,176,520 A * 12/1979 Horton ..... 91/303

* cited by examiner

*Primary Examiner*—Edward K. Look
*Assistant Examiner*—Michael Leslie

(57) ABSTRACT

A reciprocating drive system that utilizes energy available from pressure changes in flowing fluid systems, said drive used for the injection of additives into pipelines. The reciprocating drive includes a hydraulic accumulator having a gas chamber connected to a gas pipeline to contain said gas, whereby variation in the elevated pressure of the pipeline is reflected in the pressure applied to an incompressible fluid in a hydraulic conduit. The drive is capable of recycling gas used to drive the system back into pipelines.

10 Claims, 5 Drawing Sheets

ADDITIVE INJECTION DEVICE

BACKGROUND OF THE INVENTION

1. Field of the Invention

The present invention relates to linear drive systems that utilize the energy available due to pressure changes in flowing fluid systems; particularly but not exclusively to linear drive systems that may be used for the injection of additives into pipelines.

2. Description of the Prior Art

It is frequently necessary to inject an additive into a well or pipeline. These installations are often located in remote locations so the systems must be self-contained. Due to road conditions in some remote locations, chemicals which are injected into pipelines cannot be transported to the site for months at a time, and standard sources of power to run the pipeline system may not exist. Examples of additives that might be injected into pipelines include; chemicals for the prevention of line freezing due to hydration, chemicals that disperse waxes or asphaltene, and chemicals that prevent corrosion of pipelines. Therefore, there is a need for pipeline injection systems that offer both dependable and accurate metering, as well as having the capability to operate without traditional sources of power.

A number of different types of systems are available on the market for the injection of chemicals into remote pipelines or wellheads. Many of these systems utilize the natural gas carried by a pipeline as a prime mover. Use of natural gas for this purpose, however, is fraught with numerous problems.

A first problem with this type of system is that the natural gas used to drive the system is exhausted into the atmosphere, as the majority of these systems are unable to recover the gas. Pipeline natural gas often contains high levels of hydrogen sulphide, which is toxic and harmful to the environment. As a result, a number of governmental regulations have recently been put in place to restrict the release of natural gas into the environment. Further, the loss of natural gas to the environment represents a substantial, cumulative economic loss to operators.

An additional problem of using gas driven systems is a difficulty in controlling the mass of additive injected per unit of time. Gas driven systems suffer in performance due to the high compressibility of gas. Specifically, such systems are often typified by erratic piston motion, and as a result valve damage can also occur. Further, injection systems are required to operate efficiently at as low a pressure as possible so as not to restrict movement of gas within pipelines any more than necessary.

An alternative form of injection uses air/oil hybrid systems, but these are also characterized by specific deficiencies. Such systems often experience a loss of oil caused by the reciprocating motion of a piston rod. As a result of the oil loss, gas can replace oil in the system. Mixing of gas and oil in this manner causes a frothing of the oil component of the system, which can lead to erratic and uncontrolled movement of the piston rod used to inject the additive.

It is therefore an object of the present invention to obviate or mitigate the above disadvantages.

SUMMARY OF THE INVENTION

A reciprocating drive for use with a gas pipe line carrying gas at an elevated pressure, said drive comprising a drive rod, a pair of fluid motors each having a reactive surface acting on said rod to move said rod in opposite directions upon application of fluid pressure thereto, a valve connected between said pipeline and said motors and operable to direct gas from said pipeline to one or other of said motors, reversing a mechanism acting on said valve to change periodically the setting of said valve and reverse direction of movement of said rod, and a speed control device to control the rate of movement of said drive rod, said speed control device comprising a body of incompressible fluid disposed in a pair of chambers interconnected by a hydraulic conduit, each of said chambers including a cylinder and a piston moveable within the cylinder upon movement of said rod to vary the volume of said chamber, said chambers being arranged relative to one another such that a decrease in the volume of said chambers causes a corresponding increase in the volume of the other of said chambers, said speed control valve further comprising a flow control valve located in said conduit and a hydraulic accumulator connected to said conduit, said accumulator having a first chamber in communication with said conduit to contain said uncompressible fluid and a second chamber connected to said gas pipeline to contain said gas, whereby variation in said elevated pressure of said pipeline are reflected in the pressure applied to said incompressible fluid in said conduit.

BRIEF DESCRIPTION OF THE DRAWINGS

Preferred embodiments of the invention will now be described by way of example only with reference to the accompanying drawings wherein.

DESCRIPTION OF THE PREFERRED EMBODIMENTS

Figure 1:
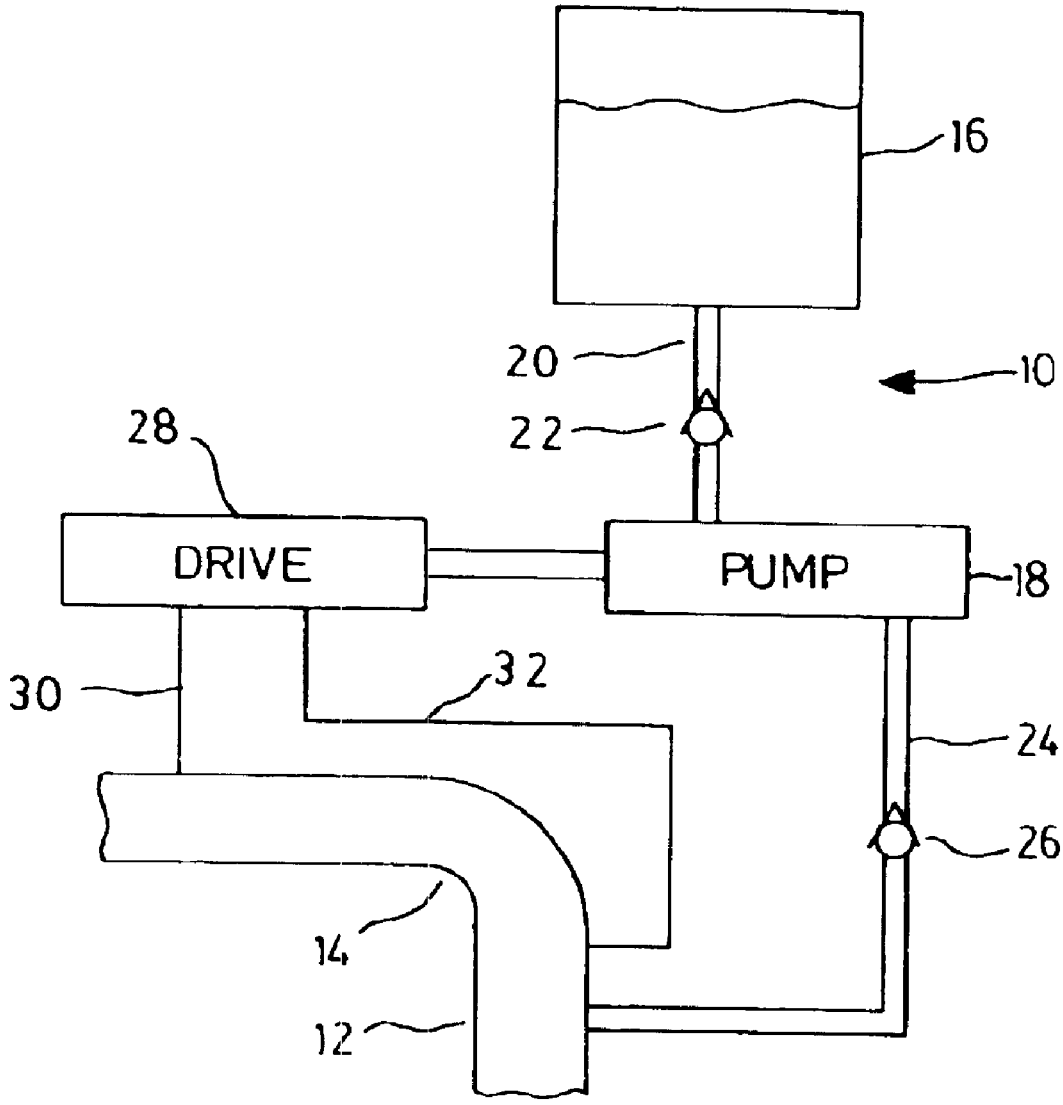
FIG. 1 is a schematic representation of a pipeline additive installation.

Referring therefore to FIG. 1, a pipeline additive system generally indicated 10 is connected to a pipeline 12 at a location where there is a pressure drop in the pipeline such as that provided by a restriction such as an elbow indicated at 14. The elbow 14 provides a pair of spaced locations along the pipeline such that there is a small but discernible difference in pressure of gas in the line. The system 10 includes a reservoir 16 containing a supply of additives and connected to a pump 18 through a supply line 20. A check valve 22 controls the direction of flow from the reservoir 16 to the pump 18. The pump 18 discharges the additive through a supply line 24 and check valve 26 to the pipeline 12. The pump 18 is driven by a drive assembly 28 that utilises the pressure of the gas or fluid in the pipeline 12 as its motive force. A supply line 30 is connected between the pipeline 12 and drive assembly 28 and an exhaust line 32 is similarly connected between the drive assembly and the pipeline 12. The connection of the supply line 30 and exhaust line 32 is at respective ones of the spaced locations along the pipeline such that there is a discernible pressure difference between the two locations.

Figure 2:
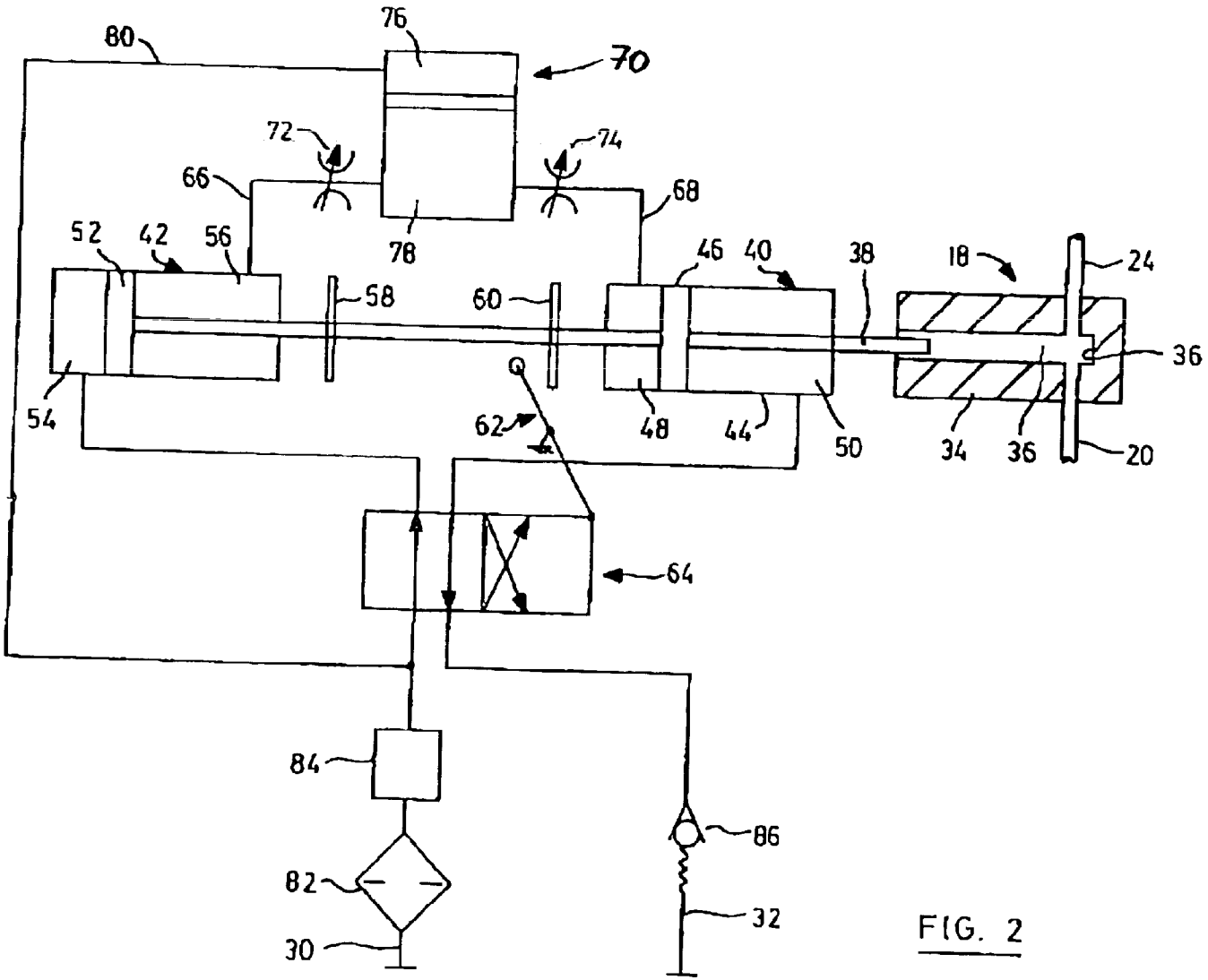
FIG. 2 is a schematic representation of the components used in the system of FIG. 1.

Further details of the drive assembly and pump may be seen from FIG. 2. The pump 18 is a reciprocating pump having a cylinder 34 with an elongate internal chamber 36. A piston rod 38 is slideable within the chamber 36 to induce fluid through the supply line 20 and expel it from the discharge line 24, which are in communication with the chamber 36.

The piston rod 38 extends from the pump 18 through a pair of actuators 40, 42. The actuator 40 has a cylinder 44 within which the rod 38 slides and a piston 46 secured to the rod 38. The piston 46 divides the cylinder 44 into a pair of chambers 48, 50. The actuator 42 is similarly includes a piston 52 secured to the rod 38 and defining a pair of chambers 54, 56.

The piston rod 38 carries a pair of adjustable stops 58, 60 that co-operate with a toggle mechanism 62 to actuate a valve 64. The valve 64 is a two position four way valve that controls the supply of gas from the inlet 30 to respective ones of the chambers 50, 54 and similarly connects the chambers 50, 54 to the exhaust line 32.

The chambers 48, 56 are connected to one another through branch conduits 66, 68 that are each connected to an accumulator 70. Adjustable flow restrictors 72, 64 are included in the branch conduits 66, 68 respectively to control the flow of fluid between the chambers 48, 56 through the accumulator 70. However, as described further below, in an additional embodiment of fluid does not have to flow through the accumulator 70. The accumulator 70 has a gas chamber 76 that is connected through a branch conduit 80 to the inlet 30 an a hydraulic chamber 78. The pressure in the gas chamber 76 thus corresponds to the pressure supplied to the inlet of the valve 64. The chambers 48, 56 and the hydraulic chamber 78 of the accumulator 70 are filled with an incompressible hydraulic fluid, typically an oil, so that movement of the rod 38 causes displacement of fluid between the chambers 48, 56, and 78.

The supply line 30 includes a filter 82 and pressure regulator 84 to control fluctuations in the pressure supplied to the valve 64. A backpressure valve 86 is connected in the exhaust line 32 to inhibit reverse flow of gas through the valve assembly.

In operation, with the components in the relative position shown in FIG. 2, the piston rod 38 is fully retracted from the chamber 36 which is filled with the additive drawn from the reservoir 16. Pressure from the inlet 30 is supplied through the valve 64 to the chamber 54 and the chamber 50 is connected through the exhaust line 32 to the lower pressure zone of the pipeline. The pressure difference between the chamber 54 and chamber 50 induces movement of the piston rod 38 to expel fluid from the chamber 36. The rate of movement of the rod 38 is controlled by the flow rate through the restrictor 72, 74 which is proportional to the pressure differential applied across the restrictors. Any variation in volume between the chambers 48 and 56 is accommodated by compression of the gas in the chamber 76. As the piston rod moves to expel fluid from the chamber 36 through the discharge 24, the abutment 58 contacts the toggle 62 and moves the valve 64 into its alternative position. In that position, the higher gas pressure is applied to the chamber 50 and the chamber 54 connected to the exhaust 32. The direction of movement of the rod 38 is thus reversed causing the chamber to again expand and draw additive into the chamber 36. The rate of movement of the piston rod 38 again is controlled by the flow of fluid through the branch conduit 66, 68 to maintain the speed at the desired rate. The reciprocal motion will continue to dispense the additive from the chamber 36 at each reversal utilising the gas supplied in the pipeline in a closed system. The stroke length of the piston rod may be adjusted by positioning the abutments 58, 60 at different locations along the piston rod 38 between the two actuators 40, 42 to co-operate with the toggle 62 at different points during the stroke.

Because the rate of movement of the rod is determined in part by the pressure difference across the restrictor 72, 74 it is necessary to prevent variation in the rate of movement due to fluctuations of the gas pressure within the line, which are in turn supplied to the chambers 50, 54. Variations in the gas pressure are transmitted through the branch conduit 80 to the gas chamber 76 and thereby cause a corresponding increase in the pressure in the fluid chamber 78. Thus, an increased pressure in the drive chambers 50, 54 due to an increase of pressure in the supply line 30 will cause a corresponding increase in the chamber 78 and maintain the pressure differential across the restrictor 72, 74 constant. The rate of movement of the piston rod 30 therefore remains constant and the volume of additive dispensed per unit of time can be maintained.

Figure 3:
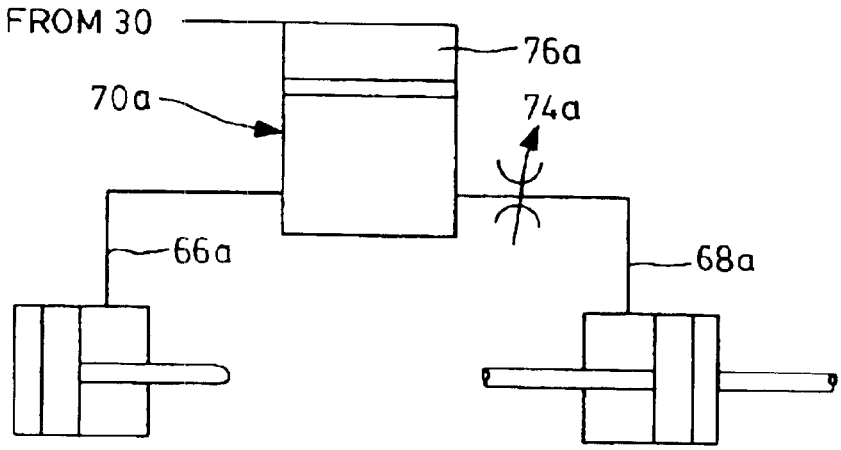
FIG. 3 is a representation of an alternative embodiment of the components used in FIG. 2.

In the above embodiment, each of the branch conduits contains a restrictor 72, 74. However, as shown in FIG. 3 in which like components will be denoted with like reference numerals with a suffix "a" added for clarity, a single variable restrictor 74*a* is included in the branch conduit 68*a*. The single restrictor 74*a* may be used to control the flow of fluid through the accumulator 70*a* and branch conduit 66*a*. Again the pressure in the chamber 76*a* is adjusted with variations of the inlet 30 to maintain the pressure differential across the restrictor 74*a*, substantially constant.

Figure 4:
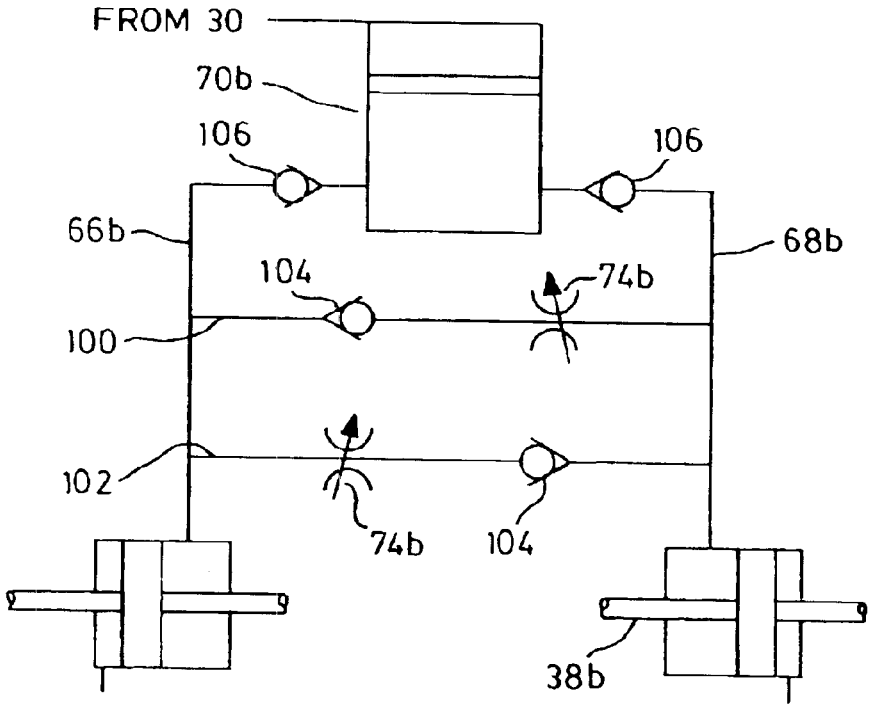
FIG. 4 is a further embodiment of the component shown in FIG. 3.

A further embodiment is shown in FIG. 4 which permits control of the speed at different rates in opposite directions. In the embodiment of FIG. 4, the branch lines 66*b*, 68*b* are interconnected by a pair of cross flow lines 100, 102. Each of the cross flow lines 100, 102 includes a check valve 104 and a variable flow restrictor 74*b*. The check valves 104 are oppositely facing and that inhibits flow in opposite directions through each of the lines 100, 102. The accumulator 70*b* is similarly protected by a pair of check valves 106. In this embodiment the accumulator 70*b* acts as a pressurized reservoir. The accumulator 70*b* provides fluid to chambers 48*b* and 56*b* as these chambers lose fluid during operation. The accumulator 70*b* ensures that fluid that is lost during operation is replaced in order to ensure that gas and fluid are not mixed. The flow through each of the restrictors 74*b* may be adjusted independently and therefore the rate of movement of the piston rod 38 in each direction may be different.

Figure 5A:
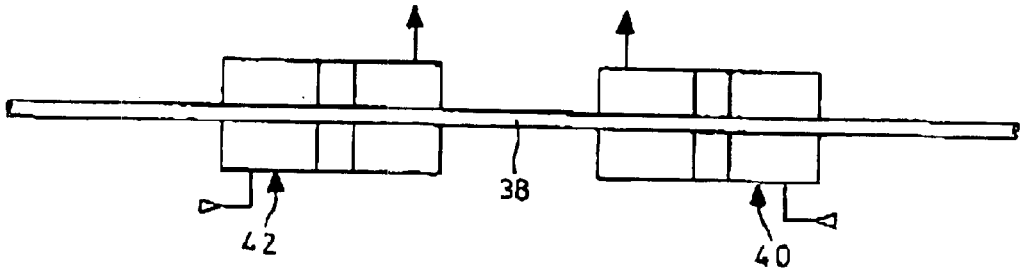
FIG. 5 is a representation of the alternative configuration of cylinders shown in FIG. 2.

In the embodiments shown in FIGS. 2, 3 and 4 the actuators 40, 42 have been shown in spaced relationship with the toggle mechanism 62 located between. Other arrangements of the actuator may be utilised as shown in FIG. 5. In FIG. 5*a*, the rod 38 extends through both sides of the actuator 42 to provide for double acting power transfer on both advance and retraction.

Figure 5B:
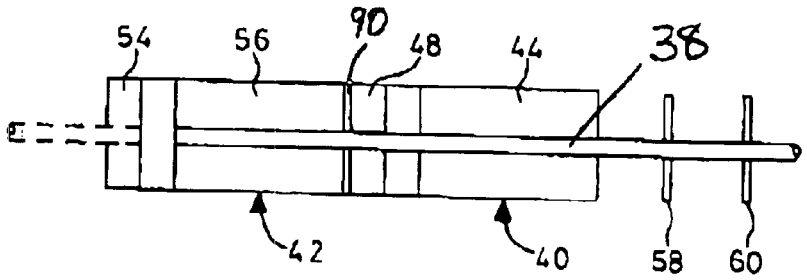
Figure 5C:
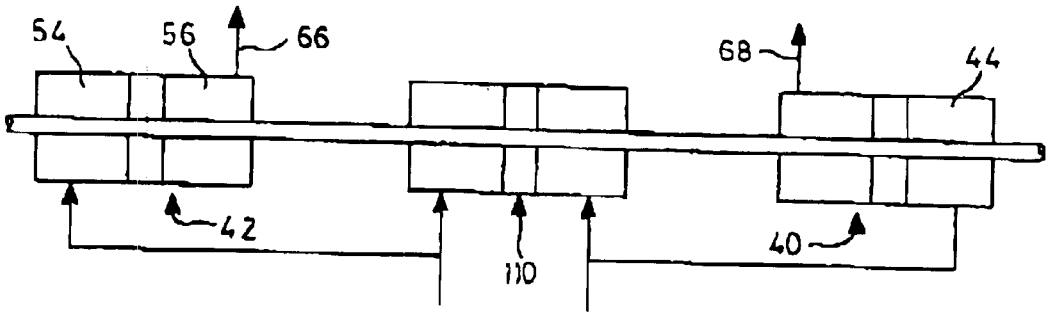

In the arrangement shown in FIG. 5*b*, the actuators 40, 42 abut each other on opposite sides of a partition 90 and the toggle mechanism 58, 60 may be moved externally of the actuators 40, 42. The partition 90 separates the oil chambers 48, 56 with the gas chamber 50, 44 outboard of the partition. The rod 38 may extend through the cylinder 42 similar to 5*a* as shown in ghosted outline. In a further arrangement shown in 5*c*, a pair of actuators 40, 42 are supplemented by an additional actuator 110 to provide additional surface area to move the piston rod 38 in each direction, thereby providing more power (Force×Distance). The actuators 40, 42 are arranged as in FIG. 5*a* with oil chambers 48, 56 and gas chambers 68, 66 respectively. If preferred, the gas chambers may be incorporated in a single actuator with oppositely acting oil chambers paired on the other actuators.

Figure 6:
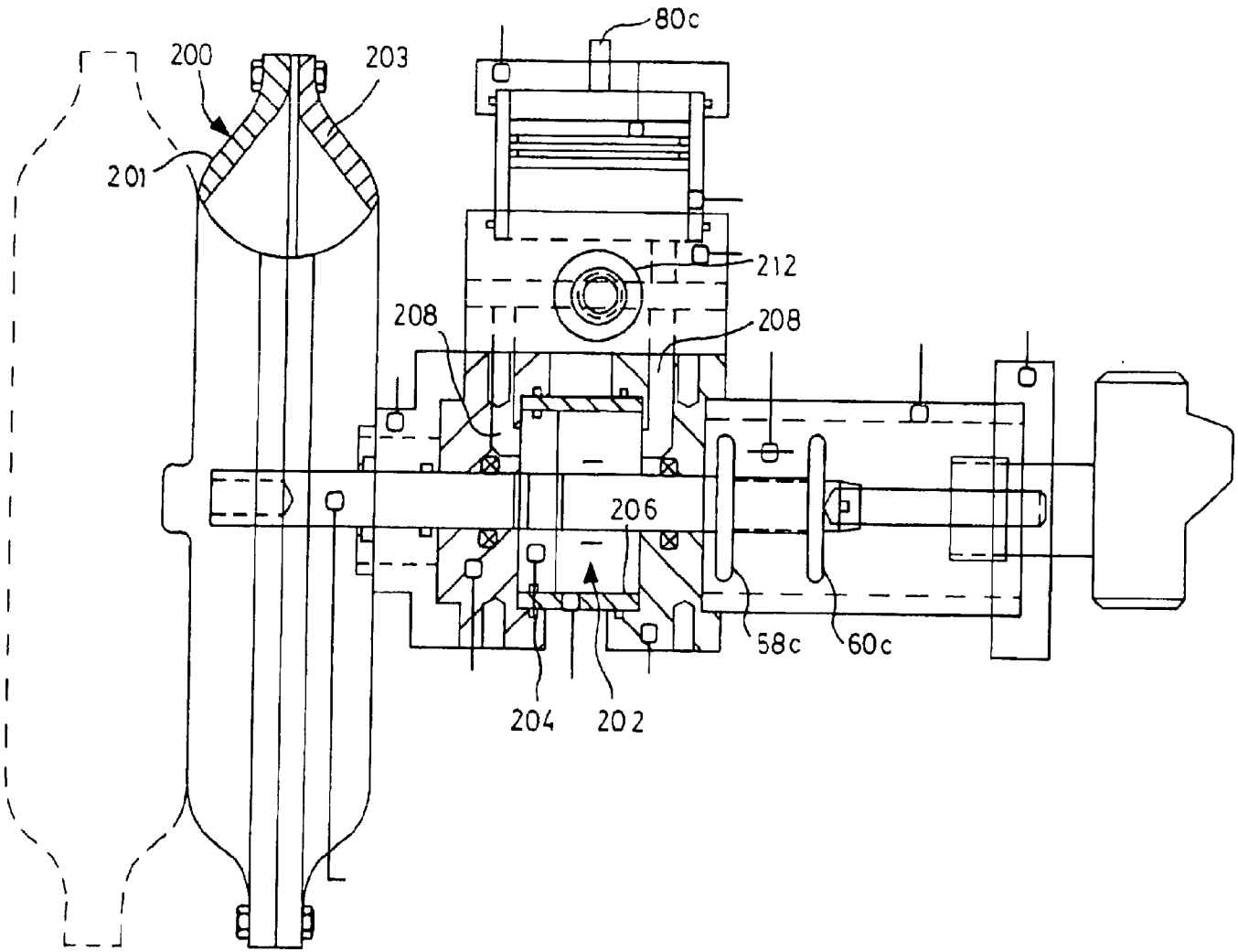
FIG. 6 is a sectional view of a further embodiment.

In a further embodiment shown in FIG. 6, the gas chambers 48, 54, 56 actuators 40, 42 are combined in a by a diaphragm device 200. The device 200 has an external housing 201 and an internal diaphragm 203 to which the rod 38 is secured. The oil chambers 48 56 are similarly combined in separate hydraulic dashpot 202. The dashpot 202 includes a piston 204 sliding in a cylinder 206 and connected through ports 208 to the accumulator 210. Pipeline pressure is applied to the accumulator through conduit 80*c*. The restrictors 72, 74 are incorporated in valve block 212 located in the body of the accumulator 210.

Flow of gas to the opposite sides of the diaphragm 200 is controlled by a valve block operated through stops 58*c*, 60*c* to reverse the porting of the valve. The function of the device is similar to that described above, with the diaphragm 200 providing the reciprocal motive force and the pipeline pressure acting through the conduit 80*c* to maintain flow through the restrictors in valve block 212 at the required rate.

In a further embodiment shown in ghosted outline in FIG. 6. Additional diaphragm devices are attached to the drive system in order to provide a greater surface area. Addition of one or more diaphragms to the disclosed embodiment is preferred if: (1) a greater force is required to operate the drive, for example if a large volume chemical injector is driven or (2) if a lower supply differential exists, such lower supply differential requiring a greater surface area to obtain a desired force.

The embodiments of the invention in which an exclusive property or privilege is claimed are defined as follows:

1. A reciprocating drive for use with a gas pipe line carrying gas at an elevated pressure, said drive comprising a drive rod, a pair of fluid motors each having a reactive surface acting on said rod to move said rod in opposite directions upon application of fluid pressure thereto, a valve connected between said pipeline and said motors and operable to direct gas from said pipeline to one or other of said motors, reversing a mechanism acting on said valve to change periodically the setting of said valve and reverse direction of movement of said rod, and a speed control device to control the rate of movement of said drive rod, said speed control device comprising a body of incompressible fluid disposed in a pair of fluid chambers interconnected by a hydraulic conduit, each of said fluid chambers including a cylinder and a piston moveable within the cylinder upon movement of said rod to vary the volume of fluid chamber, said fluid chambers being arranged relative to one another such that a increase in the volume of one said fluid chambers causes a corresponding increase in the volume of the other of said fluid chambers, said speed control device further comprising a flow control valve located in maid conduit and a hydraulic accumulator connected to said conduit, said accumulator having a first chamber in communication with said conduit to contain said uncompressible fluid and a second chamber connected to said gas pipeline to contain said gas, whereby variation in said elevated pressure of said pipeline are reflected in the pressure applied to said incompressible fluid in said conduit.

2. A device according to claim 1 wherein a pair of flow control valves are located in said conduit and said accumulator is connected between said valves.

3. A drive according to claim 1 wherein said flow control valve is adjustable.

4. A drive according to claim 1 wherein said valve includes a return line connected to said gas pipeline to return gas vented from said motors.

5. A drive according to claim 4 wherein said reversing mechanism is carried by said rod and is adjustable relative thereto to vary the stroke of said drive rod.

6. A drive according to claim 1 wherein said drive motors comprise a diaphragm device having a housing and an internal diaphragm or piston to define each often drive motors, said rod being connected to said diaphragm from movement therewith.

7. A drive according to claim 6 wherein said valve is connected to said pipeline at spaced location to establish a pressure differential between gas supplied to said motors and gas vented by said motors.

8. A drive according to claim 1 wherein said drive motors each include a piston to provide said reactive surface and a drive cylinder in which said piston is moveable.

9. A drive according to claim 8 wherein said piston is secured to said rod.

10. A drive according to claim 9 wherein said drive motor and said speed control device are located in a common actuator with said drive cylinder disposed on one side of a common piston and one of said fluid chambers disposed on the opposite side of said common piston.

* * * * *